US005184800A

United States Patent [19]

Tabler

[11] Patent Number: 5,184,800

[45] Date of Patent: Feb. 9, 1993

[54] PORTABLE SNOW FENCE SYSTEM

[75] Inventor: Ronald D. Tabler, Longmont, Colo.

[73] Assignee: The Tensar Corporation, Morrow, Ga.

[21] Appl. No.: 643,900

[22] Filed: Jan. 22, 1991

[51] Int. Cl.[5] ..... E01F 7/02

[52] U.S. Cl. ..... 256/12.5; 256/26; 256/24; 256/31; 52/146

[58] Field of Search ..... 256/12.5, 73, 24, 31, 256/19, 26; 52/146, 633

[56] References Cited

U.S. PATENT DOCUMENTS

| | | | |
|---|---|---|---|
| 10,015 | 9/1853 | Ross | 256/27 X |
| 42,166 | 4/1864 | Clapp et al. | 256/26 |
| 108,925 | 11/1870 | Middleton | 256/24 |
| 196,086 | 10/1877 | Hall | 256/26 |
| 197,806 | 12/1877 | Walter | 256/26 |
| 377,672 | 2/1888 | Eubank, Jr. | 256/31 X |
| 534,545 | 2/1895 | Breadner . | |
| 620,244 | 2/1899 | McGlashan . | |
| 629,529 | 7/1899 | Simmons | 256/26 |
| 760,407 | 5/1904 | Soper . | |
| 833,358 | 10/1906 | Wales . | |
| 836,043 | 11/1906 | Kempf, Jr. | 52/146 |
| 1,633,619 | 6/1927 | Ward | 256/26 |
| 1,773,128 | 8/1930 | Barrus . | |
| 3,273,862 | 9/1966 | Miller | 256/73 |
| 3,469,822 | 9/1969 | O'Brien | 256/26 X |
| 3,540,587 | 11/1970 | Dawbarn . | |
| 3,767,167 | 10/1973 | Rasmussen | 256/26 |
| 3,913,889 | 10/1975 | Nugent et al. . | |
| 4,031,284 | 6/1977 | Ingraham . | |
| 4,072,295 | 2/1978 | Roberts | 256/26 |
| 4,083,535 | 4/1978 | Britt | 256/24 |
| 4,299,507 | 11/1981 | Collins, II | 256/26 X |
| 4,852,192 | 8/1989 | Langan | 256/24 X |
| 4,919,394 | 4/1990 | Otte et al. | 256/68 X |

FOREIGN PATENT DOCUMENTS

| | | | |
|---|---|---|---|
| 62419 | 10/1982 | European Pat. Off. | 256/26 |
| 2207834 | 1/1978 | Fed. Rep. of Germany | 256/24 |
| 21652 | of 1895 | United Kingdom | 256/26 |
| 1589864 | 5/1981 | United Kingdom | 256/24 |
| 2068036 | 8/1981 | United Kingdom | 256/24 |

*Primary Examiner*—Randolph A. Reese
*Assistant Examiner*—Heather Chun
*Attorney, Agent, or Firm*—Jacobson, Price, Holman & Stern

[57] ABSTRACT

A portable fence system including a snow fence panel having a wood frame of 2"×6" posts bolted together at the corners, with a 4-foot wide strip of plastic snow fence material pulled taut across the center. Each panel is 8 feet long, with a height of 6'-8" or 8'-0", depending upon the application. In both cases the geometry of the frame is optimized for maximum snow trapping efficiency and maximum snow storage, and an opening at the bottom is optimized to eliminate the tendency for snow deposition at the fence. Panels are connected to one another by rebar pins passing through specially designed rotatably mounted U-clips, which also provide attachment to rebar anchors driven into the ground. The U-clip-and-pin connections allow rapid installation and take-down, and add flexibility needed for proper installation in irregular terrain. Panels can be overlapped at either the top or bottom as required to limit space between panels to 1½", which improves trapping efficiency.

24 Claims, 5 Drawing Sheets

FIG. 6
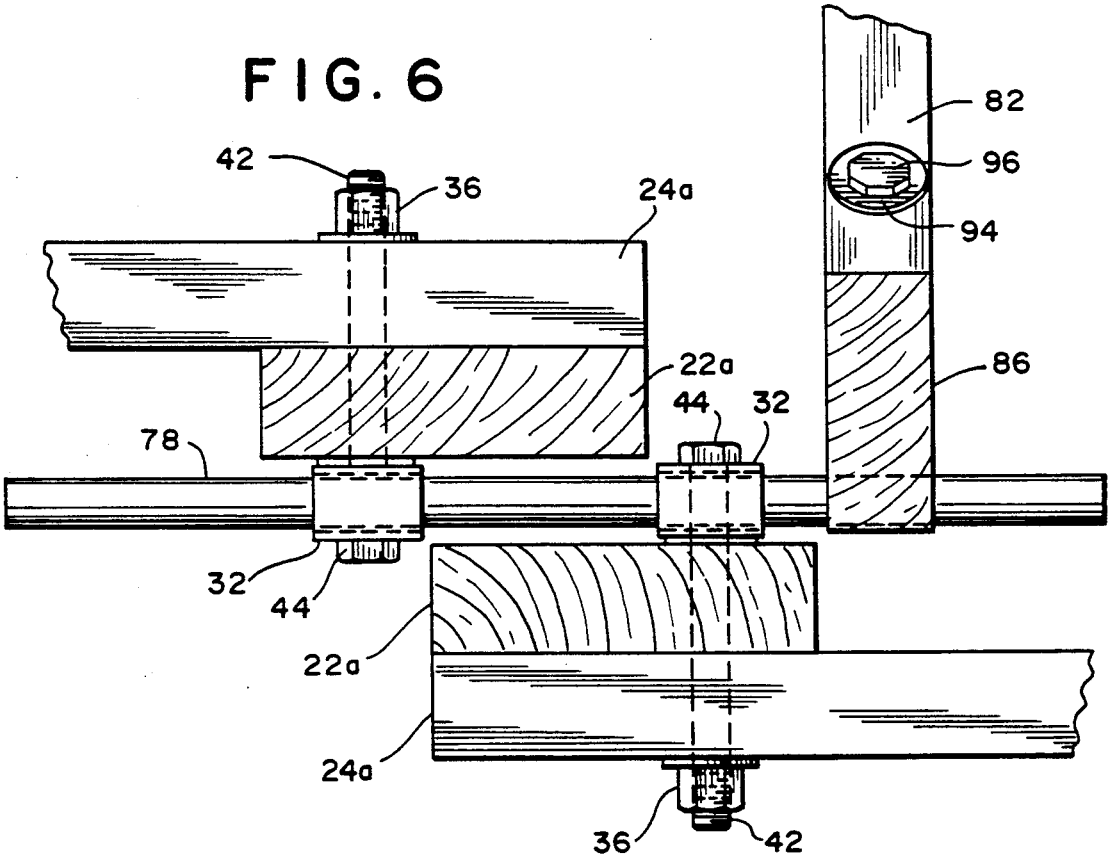
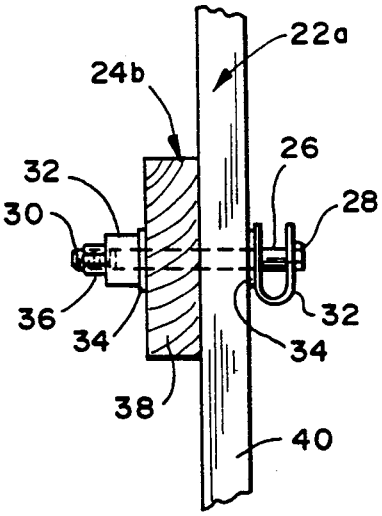
FIG. 7A
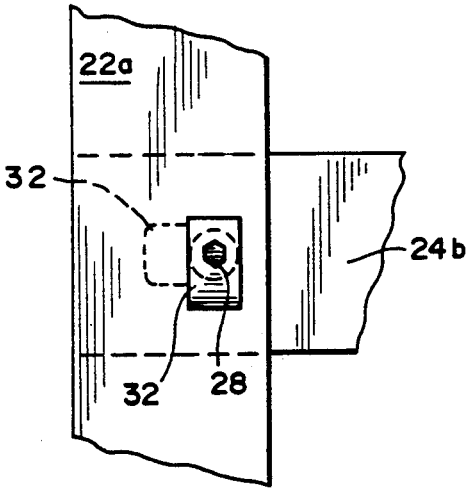
FIG. 7B

PORTABLE SNOW FENCE SYSTEM

FIELD OF THE INVENTION

This invention relates to portable snow fence panels which may be assembled into a snow fence and disassembled as required.

BACKGROUND OF THE INVENTION

A snow fence is any barrier used to protect an area from wind-transported snow. Controlling blowing snow can reduce snow removal costs, improve highway safety, and improve the distribution of snow for recreation, agriculture, and water development.

Blowing snow contributes to hazardous driving conditions by reducing visibility and causing the formation of slush and ice. Snowdrifts add to snow removal costs, but this aspect is trivial compared to the safety hazards caused by drifts. Snowdrifts can cause loss of vehicle control, reduced sight distance on curves, impair motorist visibility by increasing the concentration of snow particles at eye-level, promote ice formation, provide a barrier preventing maneuvers for collision avoidance, and render safety barriers ineffective. In addition, snowdrifts provide a source of water that can infiltrate under the pavement and cause damage to the road surface.

The first written reference to snow fences appeared in a book published in Norway in 1852. Probably the first fences in the U.S. were used along the Union Pacific Railroad in Wyoming where, by 1880, "innumerable" fences were reported to be in place. The 1930's saw widespread use of snow fences to protect roads.

After World War II, however, inexpensive fuel and improvements in snow removal equipment favored a "brute force" approach in dealing with snowdrifts. As a result, interest in snow fences and over the next 20 years or so, with very little effort made to improve passive drift control methods. In addition, snow fences were seldom as effective as they could have been because guidelines for their use were inadequate. In some cases, improperly placed fences caused more problems than existed before fencing.

The turning point for snow fences was in the early 1970's, when new guidelines were used to design a $2 million snow fence system to protect a section of Interstate Highway-80 (I-80) in Wyoming. The remarkable effectiveness of those fences in eliminating drifts and reducing accidents, provided irrefutable evidence that properly designed snow fences could work.

Although actual costs vary widely, mechanical snow removal typically costs about $3 per ton. By comparison, the cost of storing snow with fences average about 1/100th as much, or $0.03 per ton. As an example, an 8 foot tall snow fence typically costs less than $8 per foot ($25/m) to build, including easement costs. When filled to capacity, such a snow fence will store about 20 tons of snow per foot of length. Assuming the fence lasts 25 years without maintenance, the cost of storing snow would therefore be less than $0.02/ton.

By reducing the quantity of snow arriving at the road, snow fences can dramatically improve motorist visibility and reduce the formation of slush and ice. A 10-year study of the I-80 snow fence system in Wyoming, published in the Transportation Research Record in 1982, showed that fences eliminated drift formation at all locations where they were used, reducing winter maintenance costs by at least one-third. Accidents in blowing snow conditions were reduced in proportion to the extent of snow fence protection. Fencing one-half of a 62-mile section of this highway was found to prevent 54 accidents and 35 injuries over a winter having average snowfall and traffic volume, with the result that the original construction cost of the fences could be amortized in less than 15 years by the savings in property damage alone.

The evidence of how effective snow fences can be is irrefutable. It is therefore incumbent on public officials to apply this technology to improve the safety and convenience of the public; however, this technology has not been widely applied for the following reasons:

1. Lack of tall portable fences.

To be effective, fences must be at least 6 feet tall, and preferably taller. In many areas, permanent snow fences cannot be used because of conflicts with other land uses, and tall portable fences have not been considered feasible because of the more expensive supports required to withstand strong winds. Using conventional fence materials, installing, removing and storing tall fences on an annual basis is prohibitively expensive and otherwise impractical Fences taller than 5 feet or so require sturdy vertical supports such as 5-inch diameter wood posts on 8-foot centers embedded at least 3 feet or more in the ground, or guyed steel T-posts. In addition, the wind loads on taller fences require more elaborate methods of attaching the fencing material to the supports. Although 6-foot wide plastic fencing material has been marketed by at least one manufacturer, it is seldom used because of the aforementioned installation problems.

Existing fence designs do not lend themselves to economical temporary installations. Disadvantages include 1) expensive materials, 2) time-consuming installation, and 3) excessive disturbance to the site.

2. Excessive maintenance costs.

Plastic fencing materials are convenient to handle and store, and cost less than some wood-based designs. Although plastic materials can also be more durable, they are easily damaged when improperly installed. To last, plastic materials must be immobilized at supports to prevent abrasion. Proper attachment using conventional fence supports is expensive and time consuming.

3. Poor performance.

The advantages of plastic fencing materials are offset by their tendency to cause snow to be deposited in the immediate vicinity of the fence; an effect resulting from the small openings that make up the open area. Snow deposition at the fence reduces the effective fence height, and snow settlement causes the plastic fencing to sag between vertical supports. Because the storage capacity of a fence is proportional to the 2.2 power of the fence height, a loss of 6 inches reduces the capacity of a 6-foot tall fence by 18%. Snow settlement also damages the fencing material.

SUMMARY OF THE INVENTION

The portable fence system of the present invention includes snow fence panels each preferably formed of a wood frame of 2"×6" posts bolted together at the corners, with a 4-foot wide strip of plastic snow fence material pulled taut across the center. Frame cross-bracing is made unnecessary by tensioning the plastic to approximately 950 pounds, and this also prevents the plastic from sagging if it should become buried in the snow. Tensioning is accomplished with threaded rods connected to a pipe woven through the plastic.

Although the size and slope of individual panels can obviously be varied, it has been found that the geometry of the frame can be optimized for maximum snow trapping efficiency and maximum snow storage, with the opening at the bottom optimized to eliminate the tendency for snow deposition at the fence. In this respect, 8-foot wide panels with a height of 6'-8" or 8'-0" and a bottom opening of about one foot or less has been found most desirable, depending upon the application. Panels are connected to one another by rebar pins passing through specially designed U-clips, which also provide the attachment to rebar anchors driven into the ground. The U-clips are mounted on the panels by bolts, with the U-clips being rotatable for 360° of rotation, according to the angle needed for the rebar pins or rebar anchors passing through the U-clips.

The U-clip-and-pin connections allow rapid installation and take-down, and adds flexibility needed for proper installation in irregular terrain; panels can be overlapped at either the top or bottom as required to limit space between panels to 1½", which improves trapping efficiency. The U-clips are rotatable through 360°, as required to accommodate rebar anchors on irregular terrain.

The U-clip-and-pin connections are designed to withstand abrasion arising from vibration, so that only a single U-clip needs to be tightened at each connection to prevent the pin from vibrating out. The U-clips can be made from either ⅛" steel plate, or from ⅛" ultra-high-molecular-weight polyethylene. This latter material has the advantages of being less expensive than steel, and having a greater resistance to permanent deformation. The latter characteristic is desirable because the pins are not as easily removed or inserted if the steel clips become deformed as a result of overtensioning.

A unique feature of the invention is that each pair of adjacent panels shares a single 2"×6" brace member and a single windward anchor, thereby minimizing cost for materials and installation time. Braces between adjacent panels of a series of interconnected panels forming a fence can be installed on one side of the fence or on both sides of the fence, possibly alternating in direction. Alternating directions of braces maximizes stability for strong winds. For applications on ski areas, it is sometimes desirable to place the braces only on the windward side of the fence where they will not be in the way of snow grooming equipment.

Assembled panels can be stored in a width of 5" per panel; however, the design can easily be modified to allow the frame to be partially disassembled and rolled up to facilitate transport and storage. This modification requires elimination of the tensioning rods, and tensioning the plastic before attaching it to the frame. Disassembly would consist of removing bolts at two diagonally opposite corners, folding each pair of frame members together, and then rolling up the assembly.

Snow storage capacities of fences of the present invention are 3 to 4.6 times that of a conventional 4-foot snow fence. At a 6'-8" height, 13.5 tons of snow per foot of fence length is restrained which is 3 times that of a conventional 4-foot tall fence. At an 8'-0" height, 20.2 tons of snow per foot of fence length is restrained which is 4.6 times that of a conventional 4-foot tall fence.

A fixed bottom gap and lower horizontal frame member prevent snow from being deposited in the immediate vicinity of the fence. This maximizes snow storage capacity and snow trapping efficiency, prevents damage to the fence, and allows the fence to be removed at any time.

The fence can be erected with a layback angle to accommodate the terrain and space available. For example, a layback angle of 15° increases the snow storage capacity by as much as 25%. The design allows various angles to be maintained even when traversing irregular terrain. If a right of way for a road was only wide enough for a 4.7 foot tall fence, the fence could be inclined at 45°.

The ability to vary the inclination angle allows the fence to be custom-designed for specific applications. Inclining the top of the fence into the wind, for example, produces a jetting action under the fence that displaces the drift farther downwind.

Panels can be fabricated quickly and inexpensively. Materials cost less than $46 for the 6'-8" version, and $50 for the 8-foot version. Time required for fabrication of either height is 0.75 man-hours.

Weighing about 70 pounds, the panels are easily handled and erected by one person. Using plastic fencing material in place of wood reduces weight as well as cost.

Field installation of prefabricated panels requires approximately 3 man-hours per 100 feet of fence, which is less than the time required to install a conventional 4-foot snow fence. Field installation of the 8-foot tall fence requires 90% less time than that required to build a series of conventional 4-foot fences having the equivalent storage capacity.

The fences can be installed and removed with less disturbance to vegetation or soil than is currently required for conventional installations using steel T-posts. The design allows such rapid installation that it would be feasible to install the fence for short-term protection to improve visibility at accidents or to prevent drifting at construction sites. The design will withstand 100-mile-per-hour winds.

Some of the unique features of the invention are:

1. Combination of wood and plastic fencing reduces cost of materials, reduces weight, and maximizes snow trapping efficiency;
2. Frame support for plastic facilitates installation, allows proper tensioning of plastic to eliminate sagging due to snow settlement, improves durability of plastic, improves snow trapping efficiency;
3. U-clip-and-pin connectors are unique and effective;
4. Each pair of panels share a single brace and anchor;
5. Brace attachment allows fence to be inclined at optimum angle;
6. Either the 6 or 8-foot heights can be easily installed by one person;
7. Using high-tensile strength plastic fencing eliminates need for diagonal frame braces, thereby reducing cost and weight; and
8. Design and placement of connections allows panels to be overlapped to accommodate irregular terrain.

It is therefore one object of the present invention to provide a snow fence panel having a frame made of wood and including a tensioned plastic mesh material secured within the frame.

It is another object of the present invention to provide a snow fence system providing unique means to connect a plurality of panels to form a snow fence in a simplified and reusable manner.

It is yet another object of the present invention to provide such a snow fence system with the flexibility of inclining the angle of the snow fence and connecting braces to the individual panels, as necessary, for particular applications.

It is still another object of the present invention to provide a snow fence system utilizing a novel U-shaped connector which provides a limited amount of resilience to protect the connection against failure while permitting universal connection between multiple panels as well as between the panels and braces and between the braces and anchoring means.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 6 is a plan view of an interconnection of adjacent panels with a support brace.

FIG. 7A is a side elevation of an interconnection of a vertical post with a horizontal post at a lower position.

FIG. 7B is an enlarged view of the area encircled in FIG. 1 and labelled "Detail 7".

DETAILED DESCRIPTION OF THE PREFERRED EMBODIMENTS

Figure 1:
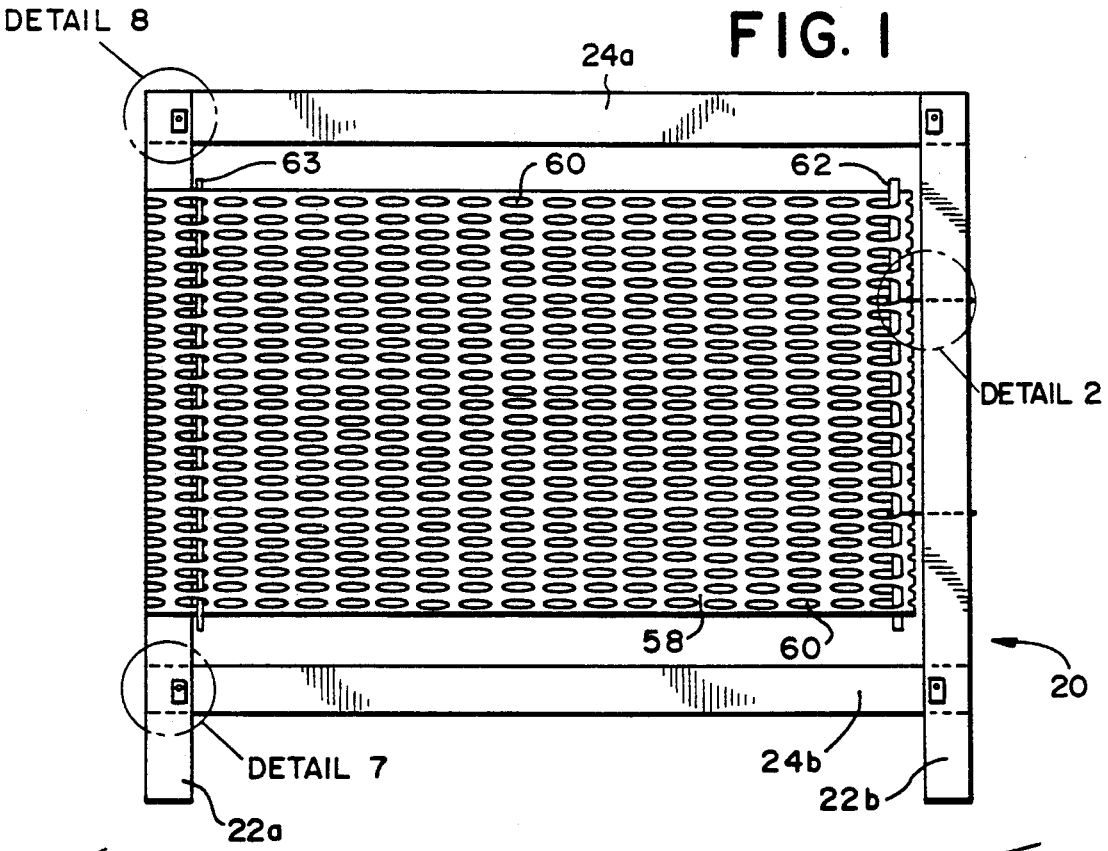
FIG. 1 is a front elevation view of a single snow fence panel.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose. Moreover, while reference is made to optimum dimensions and preferred materials, it is to be understood that the invention, in its broader aspects, is not to be limited to these particular details.

With reference to the drawings, in general, and to FIGS. 1 through 4, in particular, a snow fence panel embodying the teachings of the subject invention is generally designated as 20. With reference to its orientation in FIG. 1, the snow fence panel 20 includes a frame having two vertically extending posts 22*a*, 22*b* connected to two horizontally extending posts 24*a*, 24*b*. The posts 22 and 24 are preferably made of two inch by six inch wood planks.

The lowermost horizontal post 24*b* interconnects the two vertical posts 22 at a spacing of one foot above the lowermost edge of the vertical posts 22 and above ground level 21 when panels 20 are interconnected to form a snow fence. The uppermost horizontal post 24*a* interconnects the two vertical posts 22 at the top edge of the vertical posts 22.

The details of the connection of the horizontal and vertical posts is shown in FIGS. 7A and 7B and FIGS. 8A and 8B.

In FIG. 7A, a ½ inch diameter by six inch machine bolt 26, having head 28 and threaded end 30, joins vertical post 22*a* and horizontal post 24*b*. Secured between the head 28 of the bolt 26 and the vertical post 22*a* is a U-clip 32 and a washer 34. Similarly, on the opposite side of the joined posts 22*a* and 24*b*, is located a washer 34 and a U-clip 32, turned 90° to the U-clip on the opposite side of the bolt, and held on the threaded end 30 of the bolt 26 by a ½ inch diameter lock nut 36. By this arrangement, end face 38 of horizontal post 24*b* is held flush against outer face 40 of the vertical post 22*a*. The two U-clips are used for holding a connection pin and an anchor pin which extend perpendicular to each other in the example shown. Therefore, the two U-clips are perpendicular to each other, as will be explained in more detail later.

Figure 8A:
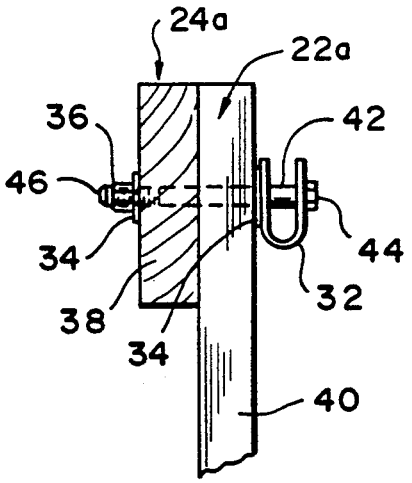
FIG. 8A is a side elevation of an interconnection of a vertical post with a horizontal post at an upper position.
Figure 8B:
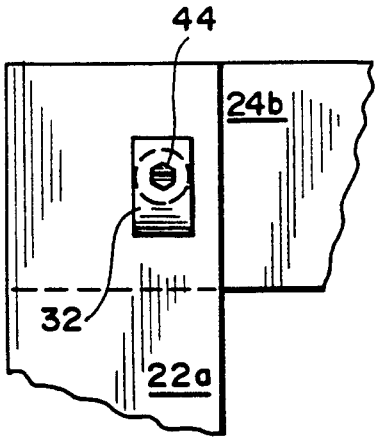
FIG. 8B is an enlarged view of the area encircled in FIG. 1 and labelled "Detail 8".

Similarly, with reference to FIGS. 8A and 8B, a single U-clip 32 is used with a ½ inch diameter by five inch length machine bolt 42, having head 44 and threaded end 46, to secure the upper end of vertical post 22*a* with horizontal post 24*b*. Again, a washer 34 is interposed between the vertical post 22 and the U-clip 32 on the front of the panel 20 with only a washer 34 and a lock nut 36 securing the vertical post and horizontal post from the rear as shown in FIG. 8A.

Figure 10:
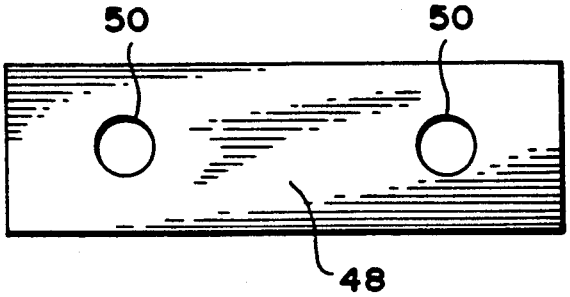
FIG. 10 is a plan view of a plate used to make a U-clip.
Figure 11:
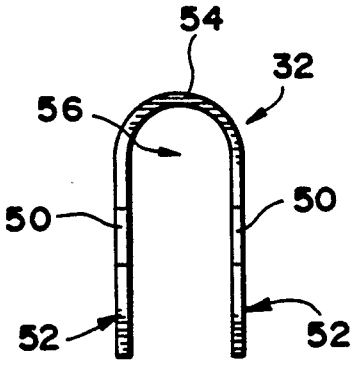
FIG. 11 is an end view of a bent plate forming a U-clip.

In FIGS. 10 and 11, the details of a U-clip 32 are shown. Originally, the clip is a ⅛ inch steel plate 48 having two 9/16 inch diameter holes 50. The plate 48 is bent into a U-shape formation as shown in FIG. 11 to form two legs 52 extending parallel to each other and each having a hole 50. The two legs 52 are joined by a semi-circular cross piece 54. The gap 56 formed between the two legs 52 and the cross piece 54 will be referred to with respect to the other figures in the anchoring of a plurality of snow panels and for interconnection of adjacent snow panels.

Returning to FIG. 1, extending horizontally between the vertical posts 22*a*, 22*b* is a plastic panel 58 having a height of four feet and a width of eight feet. The right hand end portion of the panel 58 is removed for purposes of clarity to show the details of connection of the panel 58 to the vertical post 22*b*.

The panel 58 is commercially available from Tensar Corporation as Tensar fencing product number UX3100. Spaced symmetrically throughout the panel 58 are a series of oval openings 60 forming a plurality of columns and rows.

Figure 2:
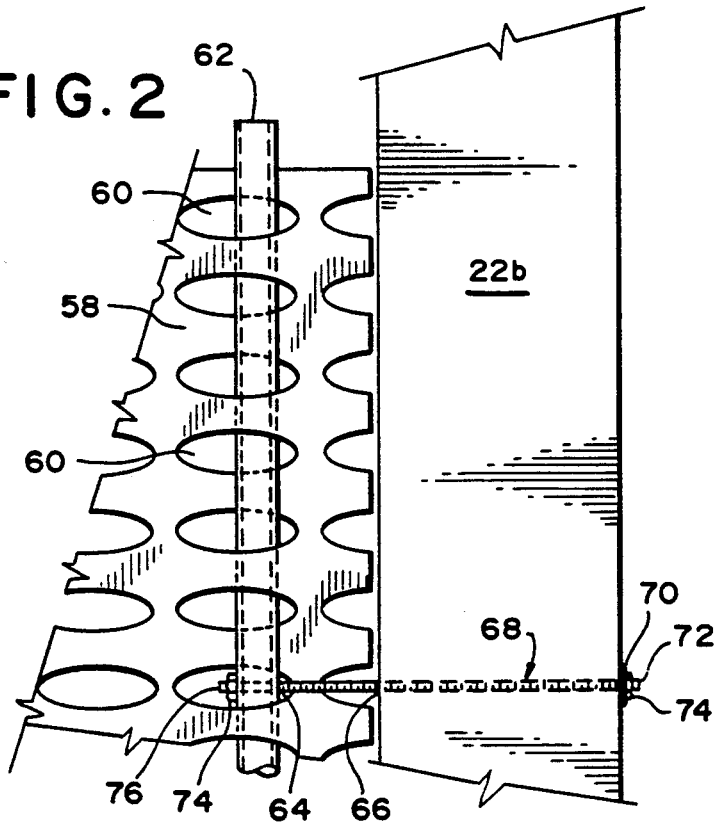
FIG. 2 is an enlarged view of the area encircled and labelled "Detail 2" in FIG. 1.
Figure 3:
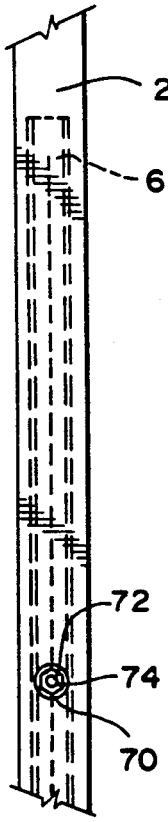
FIG. 3 is a side elevation view from the right side of FIG. 2.

To secure the panel 58 between vertical posts 22*a*, 22*b* of snow fence panel 20, a pipe (Sched. 40) or steel conduit 62 having a ½ inch inside diameter and a length of 50 inches is threaded in an overlapping and underlying pattern through openings 60 as shown in FIG. 2. At two locations spaced 25 inches apart along the length of the conduit 62 are located two 5/16 inch diameter holes 64 which are aligned with a 5/16 inch diameter hole 66 located in the vertical post 22*b*. A threaded rod 68, ¼ inch diameter by 12 inches long, passes through opening 64 of the conduit 62 and opening 66 of the vertical post 22*b*. A washer 70 is located at end 72 of the rod 68 and a ¼ inch diameter nut 74 secures end 72 of the rod 68 to the post 22*b*. At the opposite end 76 of the rod 68 is located a ¼ inch diameter nut 74 to secure the end 76 of the bolt 68 to the conduit 62.

The conduit 62 on the right hand side of FIG. 1, at post 22*b*, includes two of these tensioning connections. On the left side of FIG. 1, the plastic fencing is entirely wrapped around the vertical post 22*a* and secured by weaving conduit 63 through the openings of the fence adjacent to the post 22*a* and through the opening at an end of the panel 20 so that the fencing forms a sleeve around vertical post 22*a*. Conduit 63 is a light walled conduit, preferably a steel conduit having a ½ inch diameter and a wall thickness of 0.03 inches. The panel 58 is pulled taut by hand after which the nuts 74 located on the outside of the vertical post 22*b* are tightened until the fencing is tensioned to a one inch elongation. The panel 58 may be trimmed, as long as the openings 60 through which conduits 62, 63 are threaded are unaffected. A single snow fence panel 20 is thereby formed.

Figure 4:
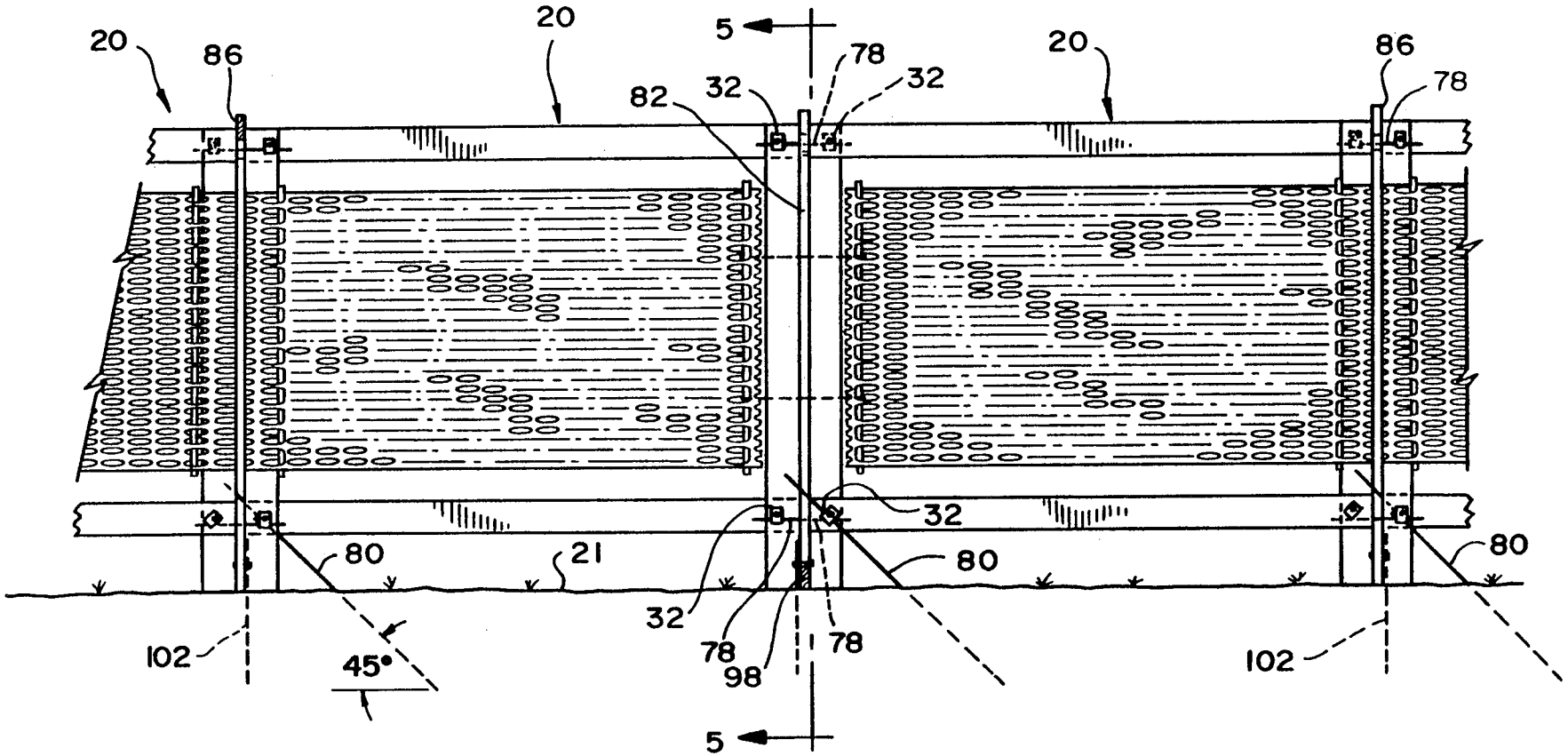
FIG. 4 is a front elevation of a plurality of assembled snow fence panels.

In FIG. 4, a plurality of adjacent snow fence panels 20 are shown interconnected to form an elongated snow fence. In FIG. 4, alternate panels are reversed so that the U-clip 32 shown in solid lines at the top connection of horizontal post 24*a* and vertical posts 22*a*, 22*a*, as shown in FIGS. 8A and 8B, is on only one panel; the adjacent U-clip being in dotted lines to indicate that the U-clip is hidden.

Extending along and parallel to post 24*a* between the U-clip 32 of one panel and the U-clip of an adjacent panel at the top of the panel is a pin 78, preferably a #6 rebar having a length of sixteen inches. The pin 78 extends horizontally through the gap 56 of a U-clip 32, shown in solid lines, and then extends through a gap 56 of an adjacent U-clip 32 shown in dotted lines. This is best shown in FIG. 6. As shown in FIG. 6, two adjacent panels 20 overlap each other by 3½ inches at the most along their respective vertical posts 22*a*, 22*a* (since the panels are reversed), and are interconnected by a pin 78 passing horizontally through clips 32 of adjacent panels at the top of each panel. By the tightening of nuts 36, the pin 78 is held within the gap 56 of the U-clips 32.

Similarly, at the bottom of the adjacent panels, a pin 78 passes horizontally through adjacent U-clips 32 which, as shown in FIG. 7A, are located on both sides of the panel so that the pin 78 may pass centrally between adjacent panels. However, because U-clips 32 are located on both sides of the panel at the bottom of each panel, a stabilizing pin 80, preferably #6 rebar of a four foot length, passes vertically through a U-clip 32 located on the outside of one of the two adjacent panels and anchors the panel by having at least two feet of its length extending into the ground at an angle of 45°. The pin 80 is secured vertically within the gap 56 of a U-clip 32 on one side of a snow panel and the pin 78 is secured horizontally within gap 56 of a U-clip on an opposite side of a snow panel by the tightening of bolt 26.

Figure 5:
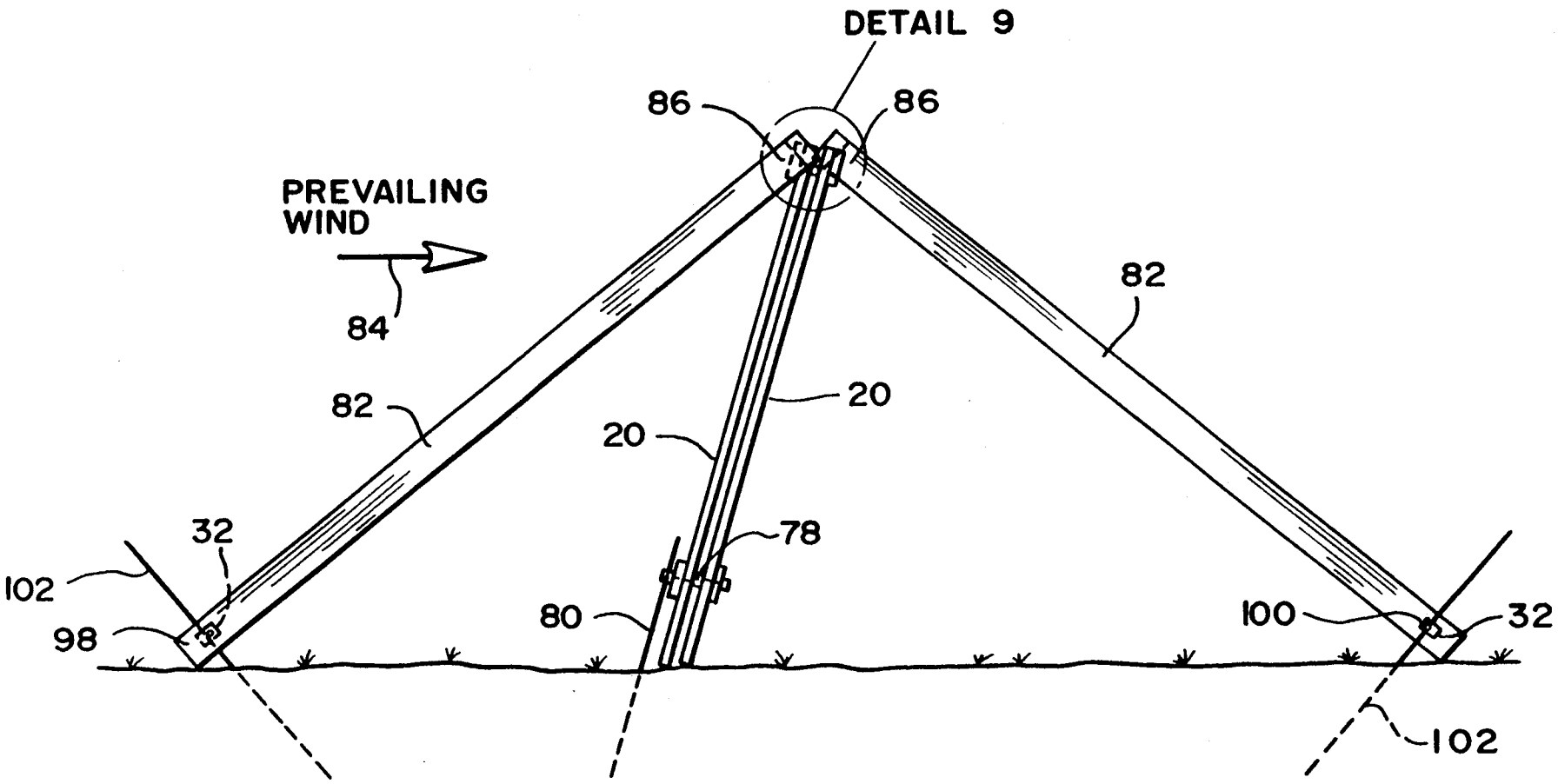
FIG. 5 is a sectional view taken along line 5—5 of FIG. 4.
Figure 9:
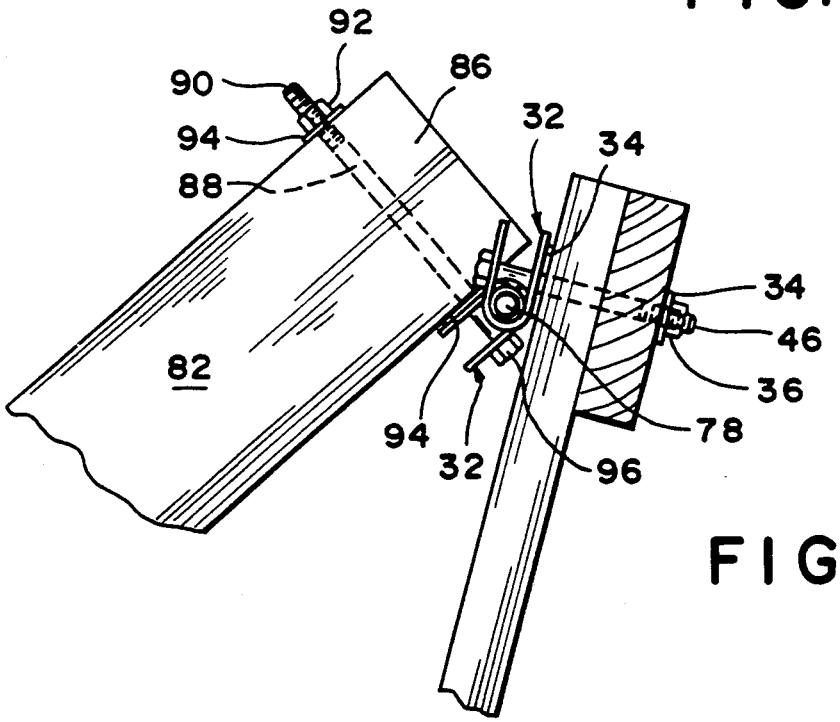
FIG. 9 is an enlarged view of the area encircled and labelled "Detail 9" in FIG. 5.

As shown in FIGS. 5 and 9, a row of interconnected snow fence panels 20 are stabilized by the use of braces 82, preferably two inch by six inch studs of ten foot length, so as to incline the assembled interconnected snow panels at a variable layback angle against the prevailing wind as indicated by arrow 84. The upper end 86 of each brace 82 includes a ½ inch diameter by 8 inch long machine bolt 88, having threaded end 90 projecting from the brace and secured to the brace by a ½ inch diameter nut 92 and washer 94. On the opposite side of the brace 82 is located a U-clip 32 and washer 94 secured by bolt head 96.

Pin 78, which as explained with reference to FIG. 4, passes through the U-clips 32 of an upper end connection as shown in FIG. 8A, also passes through a U-clip 32 mounted by bolt 88 onto end 86 of brace 82. Alternate arrangements of a connection of brace 82 to two interconnected panels are shown (1) in FIG. 6, and (2) in FIGS. 4, 5 and 9.

By the tightening of the nuts 92, the pin 78 in gap 56 of the U-clip 32 connected to the brace 82 is secured to the brace 82. At a bottom end 98 of the brace 82 a U-clip 32 is held by a ½ inch diameter by 3½ inch length machine bolt 100 so that an anchor 102 extends through the U-clip and into the ground. The anchor 102 may be secured within the gap 56 of the U-clip in the same manner as described above.

As shown in FIG. 4, braces 82 are located between adjacent panels 20 separated by 1½ inches to accommodate brace 82 in alternating directions so that in FIG. 4, two braces 82 having their upper end 86 exposed are shown spaced laterally from a brace 86 centrally located in the Figure with its lower end 98 exposed. In the alternate embodiment of FIG. 6, adjacent snow panels are overlapped with a brace 82 secured to one side of the pin 78 with the upper end 86 exposed. It is understood that an adjacent brace 82 between the next two adjacent fence panels 20 would probably extend in an opposite direction from the brace 82 shown in FIG. 6. However, it is envisioned as forming part of the present invention that all braces extending between adjacent panels would extend in the same direction, as was discussed previously with reference to ski slopes.

A plurality of interconnected snow panels are preferably placed 235 feet or more from a road or facility to be protected. Their snow storage capacity is equal to 13½ tons of snow per foot of fence which is equivalent to three rows of four foot fence.

Having described the invention, many modifications thereto will become apparent to those skilled in the art to which it pertains without deviation from the spirit of the invention as defined by the scope of the appended claims.

I claim:

1. A snow fence comprising:

a plurality of interconnected snow fence panels, each snow fence panel including a frame having two vertical posts, each vertical post having two ends, and two horizontal posts, each horizontal post having two ends, connecting means for connecting said horizontal posts to said vertical posts with one of said horizontal posts being spaced from one end of each of said vertical posts, said connecting means including a bolt extending through one said horizontal post and one said vertical post and at least one U-shaped clip rotatably mounted on at least one end of said bolt, securing means extending through said at least one U-shaped clip at connecting of said horizontal posts to said vertical posts for securing adjacent snow fence panels together, and anchoring means secured to said securing means for anchoring said snow fence panel to the ground, said anchoring means including a brace secured to adjacent snow fence panels by said securing means, said anchoring means being secured offset from said vertical posts of adjacent snow fence panels.

2. A snow fence as claimed in claim 1, wherein said brace includes a U-shaped clip at two ends of said brace.

3. A snow fence as claimed in claim 1 wherein adjacent braces extend from said snow fence panels in at least one direction.

4. A snow fence as claimed in claim 1, wherein adjacent snow fence panels are reversed in orientation.

5. A snow fence as claimed in claim 1, wherein said securing means is a connecting pin.

6. A snow fence as claimed in claim 1, wherein said snow fence panels are located at an inclined angle by said anchoring means.

7. A fence system comprising a plurality of fence panel members, connector means for releasably securing a pair of panel members to each other, each connector means including at least one clip means rotatably carried by each panel member, an elongated connector member, said connector member having portions releasably secured to said clip means on each of two panel members, and at least one brace means, said brace means carrying a clip means, and said connector member also having a portion releasably secured to said clip means on said brace means.

8. A fence system as claimed in claim 7, wherein each clip means includes a U-shaped element including two leg members having free end portions spaced from each other, and a resilient connecting portion spaced from said free end portions, and securing means carried by said panel member and joining said free ends of said clip means to define an opening to receive said end portions of said connector member, said securing means being adjustable to selectively reduce the size of said opening in said clip means to securely grip said end portions of a connector member.

9. A fence system as claimed in claim 8, wherein said end portions of said leg members define aligned apertures, said securing means including an elongated securing member having spaced end portions, said securing member passing through said aligned apertures and rotatably supporting said clip means, one end portion of said securing member being carried by said panel member, and tightening means carried by said securing member to selectively squeeze said leg portions of said clip means together.

10. A snow fence comprising:

a plurality of interconnected snow fence panels, each snow fence panel including a frame having two vertical posts, each vertical post having two ends, and two horizontal posts, each horizontal post having two ends, said horizontal posts being secured to said vertical posts, one of said horizontal posts being spaced from one end of each of said vertical posts, a plastic panel having a plurality of spaced openings, said plastic panel being mounted in said frame of each snow fence panel, connections for securing said horizontal posts to said vertical posts including a bolt and at least one U-shaped clip, one U-shaped clip being rotatably mounted at at least one end of said bolt, securing means for connecting adjacent snow fence panels through said at least one U-shaped clip at connections of said horizontal posts to said vertical posts, and anchoring means secured to said securing means for anchoring said snow fence panels to the ground, said anchoring means including a brace secured to adjacent snow fence panels by said securing means, said anchoring means being secured offset from said vertical posts of adjacent snow fence panels.

11. A snow fence as claimed in claim 10, wherein tensioning means tension and secure said plastic panel within said frame.

12. A snow fence as claimed in claim 10, wherein said brace includes a U-shaped clip at two ends of said brace.

13. A snow fence as claimed in claim 12, wherein said U-shaped clip at one end of said brace is secured to said securing means.

14. A snow fence as claimed in claim 13, wherein said U-shaped clip at the other end of said brace is secured to an anchor pin.

15. A snow fence as claimed in claim 10, wherein adjacent braces extend from said snow fence panels in at least one direction.

16. A snow fence as claimed in claim 10, wherein adjacent braces extend from said snow fence panels in at least one direction.

17. A snow fence as claimed in claim 10, wherein adjacent snow fence panels are reversed in orientation.

18. A snow fence as claimed in claim 10, wherein said securing means is a connecting pin.

19. A snow fence as claimed in claim 10, wherein said snow fence panels are located at an inclined angle by said anchoring means.

20. A snow fence comprising:

a plurality of interconnected snow fence panels, each snow fence panel including a frame having two vertical posts, each vertical post having two ends, and two horizontal posts, each horizontal post having two ends, connecting means for connecting said horizontal posts to said vertical posts with one of said horizontal posts being spaced from one end of each of said vertical posts, said connecting means including a bolt extending through one said horizontal post and one said vertical post and at least one U-shaped clip rotatably mounted on at least one end of said bolt, securing means extending through said at least one U-shaped clip at connections of said horizontal posts to said vertical posts for securing adjacent snow fence panels together, and anchoring means secured to said securing means for anchoring said snow fence panels to the ground, said anchoring means including a brace secured to adjacent snow fence panels by said securing means, said brace including a U-shaped clip at two ends of said brace.

21. A snow fence as claimed in claim 20, wherein said U-shaped clip at one end of said brace is secured to said securing means.

22. A snow fence as claimed in claim 21, wherein said U-shaped clip at the other end of said brace is secured to an anchor pin.

23. A snow fence as claimed in claim 20, wherein adjacent braces extend from said snow fence panels in at least one direction.

24. A snow fence comprising:

a plurality of interconnected snow fence panels, each snow fence panel including a frame having two vertical posts, each vertical post having two ends, and two horizontal posts, each horizontal post having two ends, said horizontal posts being secured to said vertical posts, one of said horizontal posts being spaced from one end of each of said vertical posts, a plastic panel having a plurality of spaced openings, said plastic panel being mounted in said frame of each snow fence panel, connections for securing said horizontal posts to said vertical posts including a bolt and at least one U-shaped clip, one U-shaped clip being rotatably mounted at at least one end of said bolt, securing means for connecting adjacent snow fence panels through said at least one U-shaped clip at connections of said horizontal posts to said vertical posts, and anchoring means secured to said securing means for anchoring said snow fence panels to the ground, said snow fence panels being located at an inclined angle by said anchoring means.

* * * * *